US010519806B2

(12) United States Patent
Yokoshima et al.

(10) Patent No.: US 10,519,806 B2
(45) Date of Patent: Dec. 31, 2019

(54) TURBINE HOUSING

(71) Applicant: CALSONIC KANSEI CORPORATION, Saitama-shi, Saitama (JP)

(72) Inventors: Satoru Yokoshima, Saitama (JP); Toru Iijima, Saitama (JP); Naoki Tobari, Saitama (JP); Yasunori Kozuka, Saitama (JP); Takaharu Yamamoto, Saitama (JP)

(73) Assignee: CALSONIC KANSEI CORPORATION, Saitama-shi (JP)

( * ) Notice: Subject to any disclaimer, the term of this patent is extended or adjusted under 35 U.S.C. 154(b) by 80 days.

(21) Appl. No.: 15/773,398

(22) PCT Filed: Nov. 2, 2016

(86) PCT No.: PCT/JP2016/082646

§ 371 (c)(1),
(2) Date: May 3, 2018

(87) PCT Pub. No.: WO2017/078088

PCT Pub. Date: May 11, 2017

(65) Prior Publication Data

US 2018/0328226 A1 Nov. 15, 2018

(30) Foreign Application Priority Data

Nov. 6, 2015 (JP) ..... 2015-218366
Nov. 6, 2015 (JP) ..... 2015-218367
Nov. 6, 2015 (JP) ..... 2015-218368

(51) Int. Cl.
*F01D 25/24* (2006.01)
*F01D 9/02* (2006.01)

(52) U.S. Cl.
CPC ..... *F01D 25/243* (2013.01); *F01D 9/026* (2013.01); *F05D 2220/40* (2013.01);
(Continued)

(58) Field of Classification Search
None
See application file for complete search history.

(56) References Cited

U.S. PATENT DOCUMENTS 3,880,435 A * 4/1975 Thornbald ..... F01D 11/08 277/416
4,122,673 A * 10/1978 Leins ..... B01D 53/9413 415/177

(Continued)

FOREIGN PATENT DOCUMENTS

DE 11 2011 105 408 T5 4/2014
JP 2001-303963 A 10/2001

(Continued)

*Primary Examiner* — Michael Lebentritt
(74) *Attorney, Agent, or Firm* — Foley & Lardner LLP

(57) ABSTRACT

In a turbine housing that includes a scroll portion constituting a spiral exhaust gas passage between an exhaust inlet side flange constituting an inlet for exhaust gas and an exhaust outlet side flange constituting an outlet for the exhaust gas, the turbine housing discharging the exhaust gas to an exhaust outlet side through a turbine wheel disposed in a central portion of the scroll portion, a part of a passage face of the exhaust gas passage, in the scroll portion, is formed from a scroll member made of a casting.

15 Claims, 10 Drawing Sheets

(52) U.S. Cl.
CPC .... *F05D 2230/21* (2013.01); *F05D 2230/232* (2013.01); *F05D 2250/51* (2013.01)

(56) References Cited

U.S. PATENT DOCUMENTS

| | | | | |
|---|---|---|---|---|
| 4,726,100 | A * | 2/1988 | Etemad | B23F 15/06 29/407.05 |
| 4,834,633 | A * | 5/1989 | Etemad | B23F 15/06 418/1 |
| 2006/0133931 | A1 | 6/2006 | Burmester et al. | |
| 2010/0005798 | A1* | 1/2010 | Finkbeiner | F01D 9/023 60/597 |
| 2010/0074744 | A1* | 3/2010 | Phillips, Jr. | F01D 9/026 415/208.1 |
| 2010/0098533 | A1* | 4/2010 | Grussmann | F01D 9/02 415/203 |
| 2010/0316494 | A1* | 12/2010 | Gru mann | F01D 25/26 415/231 |
| 2011/0120124 | A1* | 5/2011 | Czerwinski | F01D 17/165 60/605.1 |
| 2011/0236197 | A1* | 9/2011 | Burmeister | F01D 17/165 415/204 |
| 2011/0274542 | A1* | 11/2011 | Inoshita | F01D 9/026 415/213.1 |
| 2011/0286837 | A1* | 11/2011 | Smatloch | F01D 25/243 415/170.1 |
| 2012/0102737 | A1 | 5/2012 | Smatloch et al. | |
| 2012/0148391 | A1* | 6/2012 | Ibaraki | F04D 29/023 415/200 |
| 2012/0235407 | A1* | 9/2012 | Blackie | F01N 13/102 285/398 |
| 2012/0275914 | A1* | 11/2012 | Yokoyama | F01D 25/24 415/204 |
| 2013/0064655 | A1* | 3/2013 | Smatloch | F01D 9/026 415/182.1 |
| 2013/0156567 | A1* | 6/2013 | Nagae | F01D 25/24 415/205 |
| 2013/0302159 | A1* | 11/2013 | Grussmann | F01D 25/243 415/215.1 |
| 2014/0119907 | A1 | 5/2014 | Maeda et al. | |
| 2015/0044034 | A1* | 2/2015 | Jinnai | F01D 9/026 415/151 |
| 2015/0176433 | A1* | 6/2015 | Schlegl | F01D 17/105 415/145 |
| 2015/0322850 | A1* | 11/2015 | Vardhana | F01D 25/166 415/177 |
| 2015/0330405 | A1* | 11/2015 | Fischer | F01D 25/125 415/200 |
| 2016/0281590 | A1* | 9/2016 | Erdel | F02B 37/001 |
| 2016/0341057 | A1* | 11/2016 | Akiyama | F01N 13/10 |
| 2018/0216494 | A1* | 8/2018 | Azuma | F01D 5/043 |
| 2018/0223679 | A1* | 8/2018 | Yokoyama | F02B 39/00 |
| 2018/0252160 | A1* | 9/2018 | Hoecker | F01D 17/14 |
| 2018/0328226 | A1* | 11/2018 | Yokoshima | F01D 9/026 |
| 2019/0071973 | A1* | 3/2019 | Sakisaka | F04D 29/263 |

FOREIGN PATENT DOCUMENTS

| | | | |
|---|---|---|---|
| JP | 2002-349275 | A | 12/2002 |
| JP | 2007-002791 | A | 1/2007 |
| JP | 2007-146715 | A | 6/2007 |
| JP | 2007-278130 | A | 10/2007 |
| JP | 2008-057448 | A | 3/2008 |
| JP | 2008-106667 | A | 5/2008 |
| JP | 2011-174460 | A | 9/2011 |
| JP | 2011-236906 | A | 11/2011 |
| JP | 2013-155646 | A | 8/2013 |
| JP | 2013-256914 | A | 12/2013 |
| JP | 2015-086706 | A | 5/2015 |
| WO | WO-2004/109062 | A1 | 12/2004 |
| WO | WO-2013/141380 | A1 | 9/2013 |

* cited by examiner (a)

(b)

TURBINE HOUSING

TECHNICAL FIELD

The present invention relates to a turbine housing used for the turbocharger of a vehicle.

BACKGROUND ART

As the turbine housing used for the turbocharger, the one made of a casting is common. In contrast, a turbine housing made of a sheet metal is disclosed in Patent Literature 1, for example. This is illustrated in FIG. 10 to FIG. 12.

As illustrated in FIG. 10 to FIG. 12, a turbine housing 1 includes a scroll portion 2, a turbine outlet piping 7, a bypass passage piping 6, and a turbine outlet flange 4. The scroll portion 2 constitutes a spiral exhaust gas passage, and the turbine outlet piping 7 is projected from this scroll portion 2 and constitutes a turbine outlet 2*b* serving as the outlet for exhaust gas. The bypass passage piping 6 is projected from the scroll portion 2 in order to constitute a bypass passage 5 bypassing the scroll portion 2 and an external exhaust gas passage (not illustrated), and is separately juxtaposed with the turbine outlet piping 7. The turbine outlet flange 4 is supported by the turbine outlet piping 7 and bypass passage piping 6. Note that, in the view, reference sign 2*a* indicates a turbine inlet, and reference sign 3 indicates a turbine inlet flange.

Then, the turbine housing 1 supports the turbine outlet flange 4, which is made of a casting and relatively heavy, with two pipings, i.e., the turbine outlet piping 7 and the bypass passage piping 6.

CITATION LIST

Patent Literature

Patent Literature 1: Japanese Patent Laid-Open Publication No. 2008-57448

SUMMARY OF INVENTION

Technical Problem

However, in the turbine housing 1 illustrated in FIG. 10 to FIG. 12, since the whole scroll portion 2 is formed from a sheet metal, the turbine housing 1 is lightweight but easily deforms due to heat and/or easily produces crack and/or the like, and thus it is difficult to secure durability.

The present invention has been made to solve the above problems, and has an object to provide a turbine housing capable of reliably preventing the occurrences of thermal deformation, crack, and/or the like of an area on the exhaust outlet side of a scroll portion including a spiral exhaust gas passage, and thereby improving stiffness and durability.

Solution to Problem

In order to achieve the above-described object, a turbine housing of the present invention includes a scroll portion constituting a spiral exhaust gas passage between an exhaust inlet side flange constituting an inlet for exhaust gas and an exhaust outlet side flange constituting an outlet for the exhaust gas. The scroll portion is formed from a scroll board made of a sheet metal and a scroll member including a material having a higher heat-resistance than that of the scroll board, and an area, in the scroll portion, on the exhaust outlet side of the exhaust gas is formed from a scroll member.

DESCRIPTION OF EMBODIMENTS

Hereinafter, embodiments of the present invention will be explained with reference to the drawings.

[First Embodiment]

Figure 1:
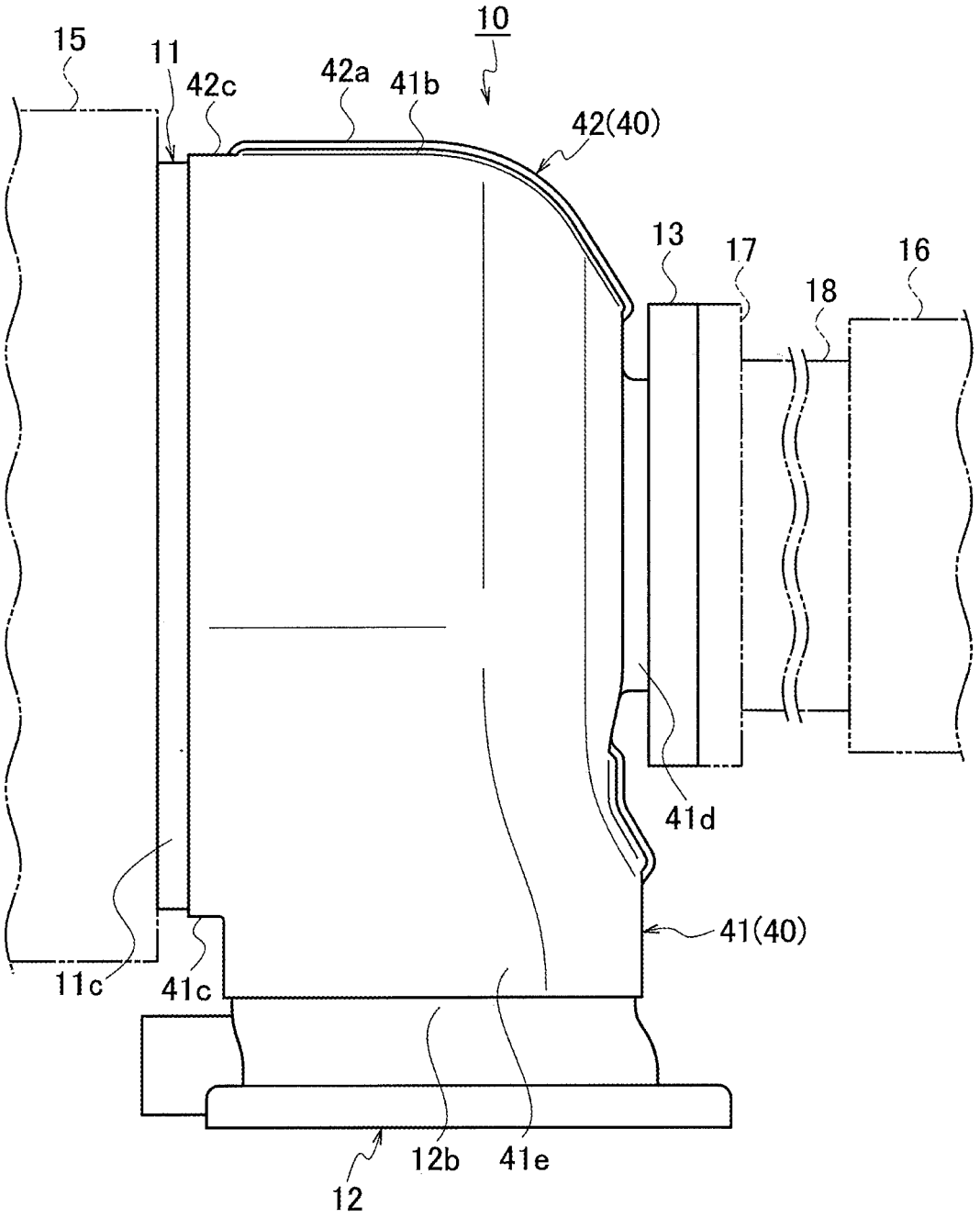
FIG. 1 is a side view of a turbine housing used for a turbocharger of a first embodiment of the present invention.
Figure 2:
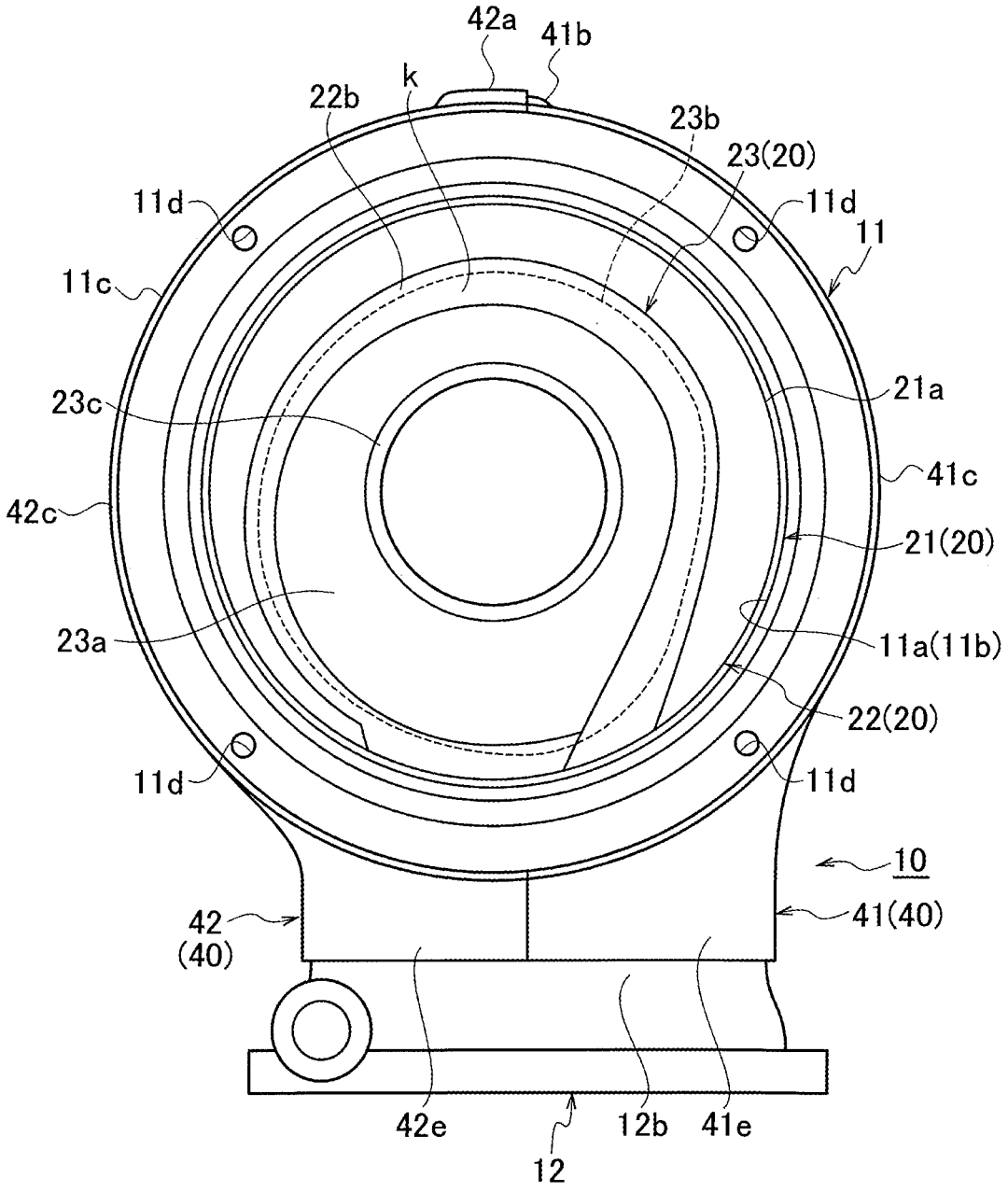
FIG. 2 is a front view of the turbine housing in FIG. 1.
Figure 3:
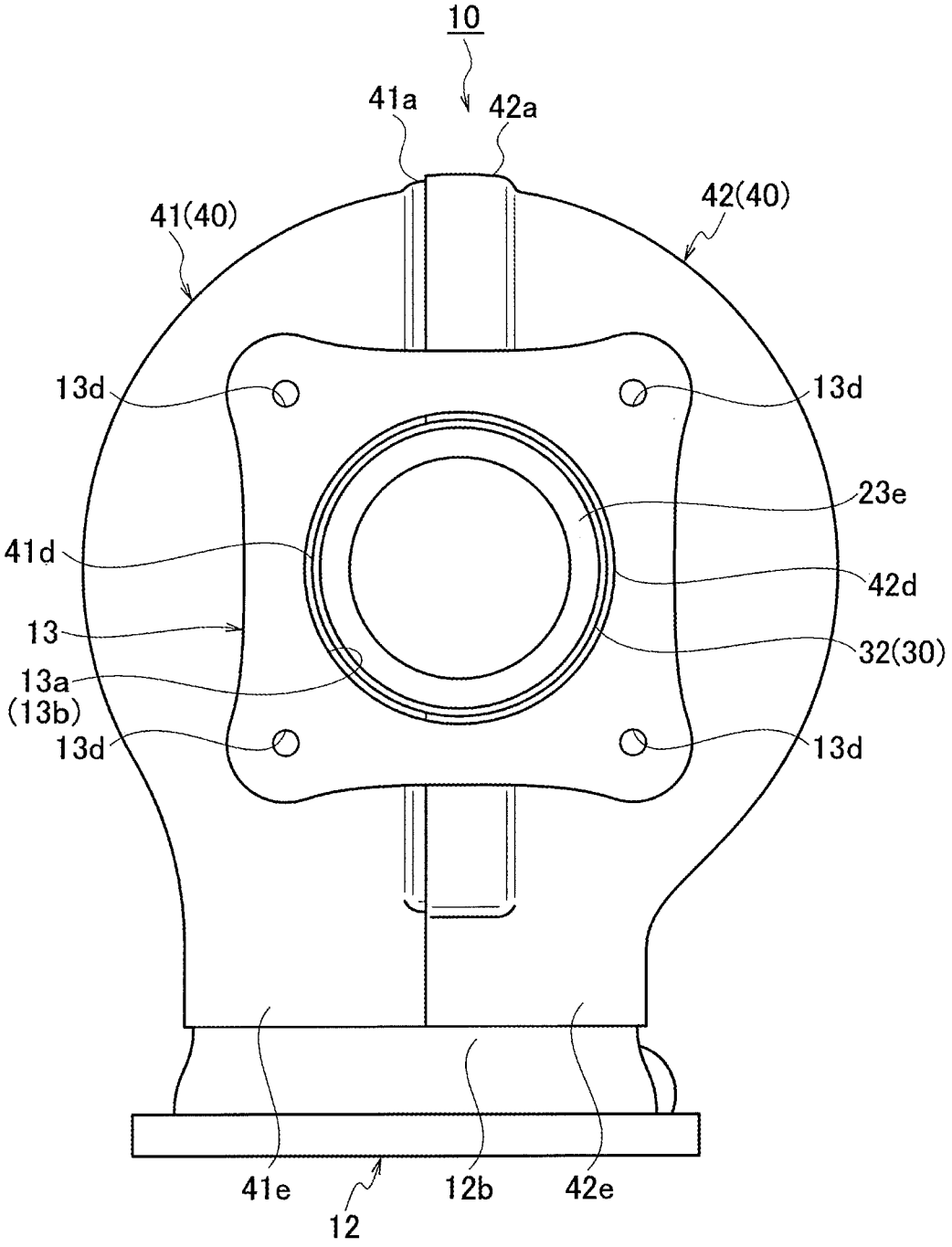
FIG. 3 is a rear view of the turbine housing in FIG. 1.
Figure 4:
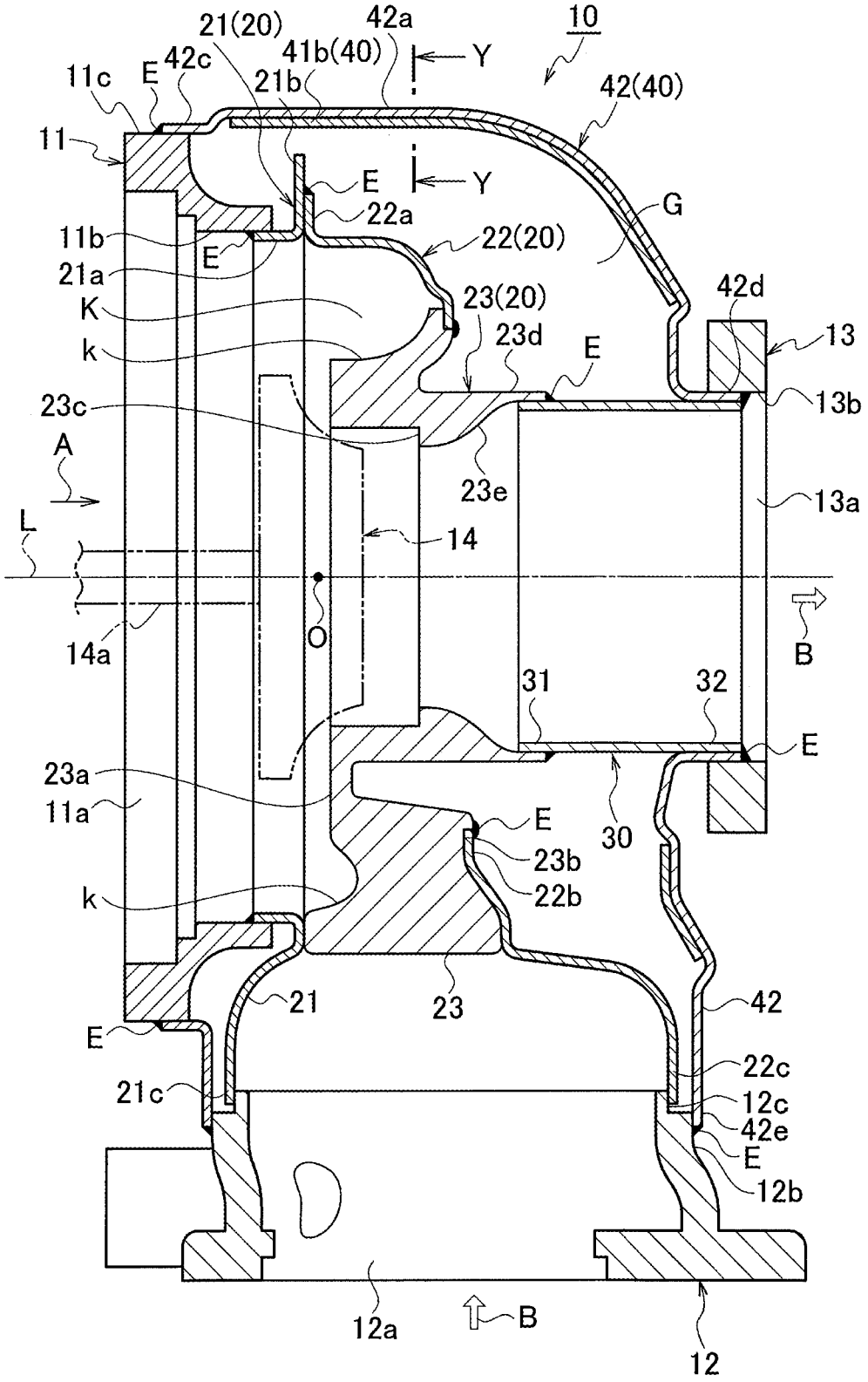
FIG. 4 is a cross sectional view of the turbine housing in FIG. 1.
Figure 5:
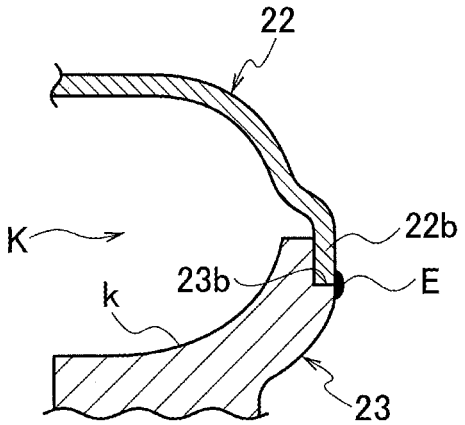
FIG. 5 is a partially enlarged cross-sectional view illustrating a joint state between a scroll board made of a sheet metal and a scroll member made of a casing of the turbine housing in FIG. 1.
Figure 6:
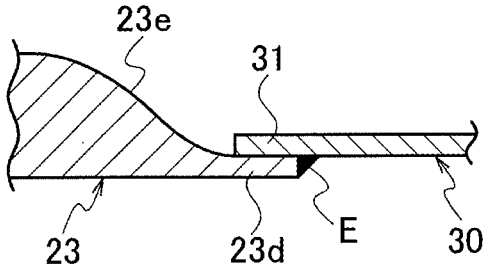
FIG. 6(*a*) is a partially enlarged cross-sectional view illustrating a joint state between the scroll member made of a casing and the exhaust pipe of the turbine housing in FIG. 1, and FIG. 6(*b*) is a partially enlarged cross-sectional view illustrating another joint state between the scroll member made of a casing and the exhaust pipe of the turbine housing in FIG. 1.
Figure 6:
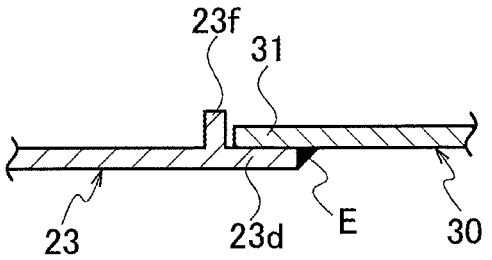
Figure 7:
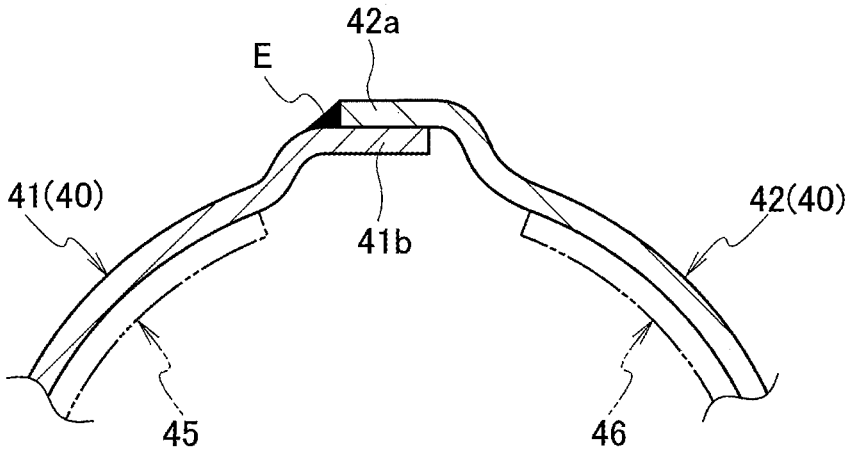
FIG. 7 is a cross sectional view along Y-Y line in FIG. 4.

FIG. 1 is a side view of a turbine housing used for a turbocharger of a first embodiment of the present invention, FIG. 2 is a front view of the turbine housing, FIG. 3 is a rear view of the turbine housing, and FIG. 4 is a cross sectional view of the turbine housing. FIG. 5 is a partially enlarged cross-sectional view illustrating a joint state between a scroll board made of a sheet metal and a scroll member made of a casting of the turbine housing. FIG. 6(*a*) is a partially enlarged cross-sectional view illustrating the joint state between the scroll member made of a casing and the exhaust pipe of the turbine housing. FIG. 6(*b*) is a partially enlarged cross-sectional view illustrating another joint state between the scroll member made of a casing and the exhaust pipe of the turbine housing. FIG. 7 is a cross sectional view along Y-Y line in FIG. 4.

A turbine housing 10 is used as the housing of a turbocharger of a vehicle. As illustrated in FIG. 1 to FIG. 4, the turbine housing 10 includes an intake-air inlet side flange 11 constituting the inlet for intake air A (intake air), an exhaust inlet side flange 12 constituting the inlet for exhaust gas B, an inner cylinder 20, an exhaust pipe 30, and an outer cylinder 40. The inner cylinder 20 constitutes a scroll portion constituting a spiral exhaust gas passage K provided between the inner cylinder 20 and an exhaust outlet side flanges 13 (flange located on an exhaust flow downstream side) constituting the outlet for the exhaust gas B. The exhaust pipe 30 is connected to a place (cylindrical portion 23*d*) on the exhaust outlet side of this inner cylinder 20. The outer cylinder 40 covers these inner cylinder 20 and exhaust pipe 30, with a gap G (predetermined interval) therebetween. The turbine housing 10 has the so-called double-shell structure. The turbine housing 10 discharges the exhaust gas B, which enters from the inlet of the exhaust inlet side flange 12, from the outlet of the exhaust outlet side flange 13 through a turbine wheel 14 disposed in a revolving central portion O (central portion) of the inner cylinder 20.

As illustrated in FIG. 1, a compressor 15 for taking in the intake air A from the outside is connected to the intake-air inlet side flange 11. Moreover, to the exhaust outlet side flange 13 for discharging the exhaust gas B, a catalytic converter 16 (exhaust gas purifying apparatus) for removing harmful contaminated materials of the exhaust gas B is connected through a linking flange 17 and a linking pipe 18. That is, the turbine housing 10 is interposed between the compressor 15 on the intake air side and the catalytic converter 16.

As illustrated in FIG. 2 and FIG. 4, the inner cylinder 20 (scroll portion) actually partitions the spiral exhaust gas passage K for the exhaust gas B inside the housing. The outer cylinder 40 completely covers the inner cylinder 20 and exhaust pipe 30, with the gap G (predetermined interval) therebetween. Thus, the outer cylinder 40 forms an outer shell structure which plays a role of protecting and at the same time insulating the inner cylinder 20 and exhaust pipe 30 and also a role of improving the stiffness as the turbine housing 10.

As illustrated in FIG. 4, the inner cylinder 20 includes: a first inner cylinder split body 21 and a second inner cylinder split body 22 each including a laminated scroll board made of a sheet metal; and a third inner cylinder split body 23 including a scroll member made of a casting which is formed by casting as a material having a higher heat-resistance than that of one made from a sheet metal. The first inner cylinder split body 21 and a second inner cylinder split body 22 are formed so as to contact each other on a surface perpendicular to an axis direction L of a turbine shaft 14*a* of the turbine wheel 14. The third inner cylinder split body 23 is located in a region (an area on the exhaust outlet side of the exhaust gas B) facing the turbine wheel 14.

As illustrated in FIG. 2 and FIG. 4, the first inner cylinder split body 21 and the second inner cylinder split body 22 are molded into a predetermined curved cylindrical shape by pressing a sheet metal. An end portion 21*b* on the rear peripheral edge side of this press-molded first inner cylinder split body 21 made of a sheet metal and an end portion 22*a* on the front peripheral edge side of this press-molded second inner cylinder split body 22 made of a sheet metal are both joined and fixed by welding. That is, the end portion 21*b* on the rear peripheral edge side of the first inner cylinder split body 21 and the end portion 22*a* on the front peripheral edge side of the second inner cylinder split body 22 are formed by being folded outward so as to have a different vertical length, respectively. The long end portion 21*b* and short end portion 22*a* are fixed by welding (the welded portion is designated by reference sign E).

Further, as illustrated in FIG. 2 and FIG. 4, the third inner cylinder split body 23 is made of a casting and formed in a predetermined curved cylindrical shape. As illustrated in FIG. 4 and FIG. 5, an end portion 22*b* on the rear peripheral edge side of the second inner cylinder split body 22 made of a sheet metal and a step-recessed end portion 23*b* on the rear peripheral edge side of the third inner cylinder split body 23 made of a casting are joined and fixed by welding (the welded portion is designated by reference sign E) from the opposite side face of a passage face k of the exhaust gas passage K. Thus, a region facing the turbine wheel 14 as an area on the exhaust outlet side of the exhaust gas B of the inner cylinder 20 is formed from the third inner cylinder split body 23 made of a casting including a scroll member made of a casting. Then, the remaining regions in the inner cylinder 20 other than the area on the exhaust outlet side are formed from the first inner cylinder split body 21 and the second inner cylinder split body 22 each made of a sheet metal including a scroll board made of a sheet metal, and have the spiral exhaust gas passage K formed therein.

Furthermore, as illustrated in FIG. 2 and FIG. 4, a front face 23*a* of the third inner cylinder split body 23 made of a casting is flat, and the area on the lower side (exhaust inlet side flange 12) thereof is formed wider than the area on the upper side (opposite side of the exhaust inlet side flange 12). That is, as illustrated in FIG. 4, in the third inner cylinder split body 23 made of a casting, a region closer to the exhaust inlet side flange 12 is formed thicker than a region on the opposite side thereof. Thus, a part of the passage face k of the exhaust gas passage K of the inner cylinder 20 is formed from the third inner cylinder split body 23 made of a casting.

Furthermore, a stepped-annular recessed portion 23*c* is formed on the exhaust inlet side of the third inner cylinder split body 23 made of a casting, while the cylindrical portion 23*d* (tubular portion) is integrally and protrusively formed on an exhaust outlet side. An annular ring-shaped reinforcing member (not illustrated) for protecting the turbine wheel 14 is fitted into this stepped-annular recessed portion 23*c*.

Further, as illustrated in FIG. 6(*a*), the inner wall of the cylindrical portion 23*d* is formed so as to have a conical inclined surface 23*e* which expands toward the outlet side, and an end portion 31 on the front side of the exhaust pipe 30 is fitted into the inclined surface 23*e* of the inner wall of this cylindrical portion 23*d*, and the both are fixed by welding (the welded portion is designated by reference sign E).

As illustrated in FIG. 1 to FIG. 4, the outer cylinder 40 is constituted from two thin plate members made of a sheet metal, i.e., a first outer cylinder split body 41 and a second outer cylinder split body 42, formed by being divided into two along the axis direction L (vibration direction when a vehicle is traveling) of the turbine shaft 14*a* of the turbine wheel 14. These first outer cylinder split body 41 and second outer cylinder split body 42 are molded into a predetermined curved shape by pressing a sheet metal. These press-molded first outer cylinder split body 41 made of a sheet metal and second outer cylinder split body 42 made of a sheet metal are joined by welding so as to completely cover the inner cylinder 20 and exhaust pipe 30, with the gap G therebetween.

That is, as illustrated in FIG. 1, FIG. 3, FIG. 4 and FIG. 7, another end portion 41*b* stepwise extending of the first outer cylinder split body 41 made of a sheet metal and one end portion 42*a* stepwise extending of the second outer cylinder split body 42 made of a sheet metal are superposed, with another end portion 41*b* of the first outer cylinder split body 41 facing downward, and another end portion 41*b* and one end portion 42*a* are fixed to each other by welding (the welded portion is designated by reference sign E) along the axis direction L (axis linear direction) of the turbine shaft 14*a* of the turbine wheel 14. Thus, another end portion 41*b* and one end portion 42*a* expand and contract in the axis direction L of the turbine shaft 14*a* when a vehicle is travelling, and therefore welding along the axis direction L prevents the welded portion from being ruptured.

Moreover, as illustrated in FIG. 7, each of plates 45 and 46 (reinforcing boards) formed from a sheet metal, which are press-molded so as to follow the curved shape of the outer cylinder 40, is fixed, by at least one-point of welding (point welding), to each of the inner surfaces of the first outer cylinder split body 41 made of a sheet metal and the second outer cylinder split body 42 made of a sheet metal, the first outer cylinder split body 41 and the second outer cylinder split body 42 constituting the outer cylinder 40.

As illustrated in FIG. 2 and FIG. 4, the intake-air inlet side flange 11 is annularly formed, and a circular opening portion 11*a* in the center thereof is the inlet for the intake air A. Then, the end portion 21*a* on the front peripheral edge side of the first inner cylinder split body 21 made of a sheet metal in the inner cylinder 20 is fixed to an inner circumferential surface 11*b* of the intake-air inlet side flange 11 by welding (the welded portion is designated by reference sign E). Moreover, each of end portions 41*c* and 42*c* on the front peripheral edge sides of the first outer cylinder split body 41 made of a sheet metal and the second outer cylinder split body 42 made of a sheet metal, the first outer cylinder split body 41 and the second outer cylinder split body 42 constituting the outer cylinder 40, is fixed to an outer circumferential surface 11*c* of the intake-air inlet side flange 11 by welding (the welded portion is designated by reference sign E). Note that, a plurality of screw holes 11*d* for screwing a bolt is formed at equal intervals in the intake-air inlet side flange 11.

As illustrated in FIG. 4, the exhaust inlet side flange 12 is substantially-annularly formed, and an opening portion 12*a* thereof is the inlet for the exhaust gas B. Then, a stepped-annular recessed portion 12*c* is formed on the upper side of an outer circumferential surface 12*b* of the exhaust inlet side flange 12. Along this recessed portion 12*c*, a lower end portion 21*c* side of the first inner cylinder split body 21 made of a sheet metal and a lower end portion 22*c* side of the second inner cylinder split body 22 made of a sheet metal in the inner cylinder 20 are formed in a semicircle arc curved shape, respectively. The lower end portion 21*c* side of the first inner cylinder split body 21 and the lower end portion 22*c* side of the second inner cylinder split body 22 are slidably abutted and fitted around this recessed portion 12*c*.

Moreover, as illustrated in FIG. 2 to FIG. 4, a lower end portion 41*e* side of the first outer cylinder split body 41 made of a sheet metal and a lower end portion 42*e* side of the second outer cylinder split body 42 made of a sheet metal, the first outer cylinder split body 41 and the second outer cylinder split body 42 constituting the outer cylinder 40 along the outer circumferential surface 12*b* of the exhaust inlet side flange 12, are formed in a semicircle arc curved shape, respectively, and are also fixed to this outer circumferential surface 12*b* by welding (the welded portion is designated by reference sign E). Note that, a plurality of non-illustrated screw holes for screwing a bolt is formed at equal intervals in the exhaust inlet side flange 12.

Furthermore, as illustrated in FIG. 3 and FIG. 4, the exhaust outlet side flange 13 is formed in the form of a substantially square plate, and a circular opening portion 13*a* in the center thereof is the outlet for the exhaust gas B. Then, each of the end portions 41*d* and 42*d* on the rear peripheral edge side of the first outer cylinder split body 41 made of a sheet metal and the second outer cylinder split body 42 made of a sheet metal, the first outer cylinder split body 41 and the second outer cylinder split body 42 constituting the outer cylinder 40, and an end portion 32 on the backside of the exhaust pipe 30 are fixed to an inner circumferential surface 13*b* of the exhaust outlet side flange 13 by welding (the welded portion is designated by reference sign E). Note that screw holes 13*d* for screwing a bolt are formed at the corner portions in the exhaust outlet side flange 13, respectively.

In the turbine housing 10 of the first embodiment explained above, as illustrated in FIG. 4, a region (area on the exhaust outlet side of the exhaust gas B) facing the turbine wheel 14 of the inner cylinder 20 (scroll portion) having the spiral exhaust gas passage K is formed from the third inner cylinder split body 23 made of a casting (scroll member made of a casting), and the remaining regions are formed from the first inner cylinder split body 21 made of a sheet metal and the second inner cylinder split body 22 (scroll board made of a sheet metal). Therefore, the occurrences of thermal deformation, crack, and/or the like of the region facing the turbine wheel 14 of the inner cylinder 20 can be reliably prevented with a simple structure, and the stiffness and durability can be further improved. Thus, a clearance (tip clearance) between the third inner cylinder split body 23 of the inner cylinder 20 and the turbine wheel 14 can be simply, reliably, and temporally secured.

Moreover, a part of the passage face k of the exhaust gas passage K of the inner cylinder 20 is formed from the third inner cylinder split body 23 made of a casting, and the region closer to the exhaust inlet side flange 12 of the third inner cylinder split body 23 is formed thicker than the region on the opposite side thereof. Therefore, the occurrences of thermal deformation, crack, and/or the like of the region facing the turbine wheel 14 of the inner cylinder 20 can be reliably prevented with a simple structure, and the stiffness and durability can be further improved.

Furthermore, since a part of the passage face k of the exhaust gas passage K of the inner cylinder 20 is formed from the third inner cylinder split body 23 made of a casting, the heat capacity on the exhaust outlet side will not decrease and thus the warming-up of an exhaust purification catalyst of the catalytic converter 16 can be promoted to activate the catalyst. Thus, the catalyst purification performance of the catalytic converter 16 can be improved.

Moreover, the inner cylinder 20 constituting the spiral exhaust gas passage K is constituted from the first and second inner cylinder split bodies 21 and 22 made of a sheet metal, and the third inner cylinder split body 23 made of a casting located at the region facing the turbine wheel 14, and is covered with the outer cylinder 40 including the first outer cylinder split body 41 made of a sheet metal and the second outer cylinder split body 42 made of a sheet metal, with the gap G therebetween, so that the inner cylinder 20 can be protected by the outer cylinder 40 and leaking of the exhaust gas B from the outer cylinder 40 to the outside can be reliably prevented.

Furthermore, as illustrated in FIG. 5, the end portion 22*b* of the second inner cylinder split body 22 made of a sheet metal and the end portion 23*b* of the third inner cylinder split body 23 made of a casting are joined by welding from the opposite side face of the passage face k of the exhaust gas passage K. Therefore, the end portion 22*b* of the second inner cylinder split body 22 and the end portion 23*b* of the third inner cylinder split body 23 can be easily and reliably welded and fixed, and the welded portion E, where the end portion 22*b* of the second inner cylinder split body 22 and the end portion 23*b* of the third inner cylinder split body 23 are joined, will not be melted by being exposed to the high-temperature exhaust gas B. Thus, leaking of the exhaust gas B from between the joined second inner cylinder split body 22 and the third inner cylinder split body 23 can be reliably prevented.

Moreover, as illustrated in FIG. 4, the lower end portion 21*c* side of the first inner cylinder split body 21 made of a sheet metal and the lower end portion 22*c* side of the second inner cylinder split body 22 made of a sheet metal in the inner cylinder 20 (scroll portion) are formed in a semicircle arc curved shape along the stepped-annular recessed portion 12*c* formed on the upper side of the outer circumferential surface 12*b* of the exhaust inlet side flange 12, respectively, and also are slidably abutted and fitted around this stepped-annular recessed portion 12*c*. Therefore, even when the inner cylinder 20 thermally expands due to the heat of the exhaust gas B, the lower end portion 21*c* of the first inner cylinder split body 21 made of a sheet metal and the lower end portion 22*c* of the second inner cylinder split body 22 made of a sheet metal will slide in an outer circumferential surface of the stepped-annular recessed portion 12*c* of the exhaust inlet side flange 12, so that displacement of the first and second inner cylinder split bodies 21 and 22 made of a sheet metal due to thermal expansion can be allowed. Thus, the thermal expansion of the inner cylinder 20 can be effectively absorbed.

Furthermore, as illustrated in FIG. 4, the cylindrical portion 23*d* is integrally and protrusively formed on the exhaust outlet side of the third inner cylinder split body 23, and the end portion 31 on the front side of the exhaust pipe 30 is fitted and fixed into this cylindrical portion 23*d*. Therefore, the exhaust gas B on the exhaust outlet side can be reliably discharged from the opening portion 13*a* of the exhaust outlet side flange 13 without leaking through the exhaust pipe 30.

In particular, as illustrated in FIG. 6(*a*), the inner wall of the cylindrical portion 23*d* of the third inner cylinder split body 23 is formed so as to have the conical inclined surface 23*e* expanding toward the outlet side, and the end portion 31 on the front side of the exhaust pipe 30 is fitted into the inclined surface 23*e* of the inner wall of this cylindrical portion 23*d* and is fixed by welding. Therefore, the end portion 31 on the front side of the exhaust pipe 30 will not go too deep in the inner wall of the cylindrical portion 23*d*, and thus the cylindrical portion 23*d* and the end portion 31 on the front side of the exhaust pipe 30 can be easily and reliably fixed by welding.

Furthermore, since a scroll member made of a casting formed by casting as a material having a higher heat-resistance than that of one made from a sheet metal is used, the third inner cylinder split body 23 located in an area on the exhaust outlet side of the exhaust gas B, the area being a part of the inner cylinder 20, can be easily and reliably manufactured.

Moreover, as illustrated in FIG. 7, each of the plates 45 and 46 is fixed by at least one point of welding to each inner surface of the first outer cylinder split body 41 made of a sheet metal and the second outer cylinder split body 42 made of a sheet metal, the first outer cylinder split body 41 and the second outer cylinder split body 42 constituting the outer cylinder 40. Therefore, distortion and/or deformation of the first outer cylinder split body 41 made of a sheet metal and the second outer cylinder split body 42 made of a sheet metal, the first outer cylinder split body 41 and the second outer cylinder split body 42 constituting the outer cylinder 40, can be reliably prevented, and vibration of the whole outer cylinder 40 can be attenuated. Thus, distortion of the first outer cylinder split body 41 made of a sheet metal and the second outer cylinder split body 42 made of a sheet metal due to thermal expansion can be effectively dispersed and prevented.

Note that, in the first embodiment, as illustrated in FIG. 6(*a*), the inner wall of the cylindrical portion 23*d* integrally and protrusively formed on the exhaust outlet side of the third inner cylinder split body 23 made of a casting is formed so as to have the conical inclined surface 23*e* expanding toward the outlet side, and the end portion 31 on the front side of the exhaust pipe 30 is fitted into the inclined surface 23*e* of the inner wall of this cylindrical portion 23*d* and is fixed by welding. However, as illustrated in FIG. 6(*b*), a positioning rib 23*f* (projection) for positioning the end portion 31 on the front side of the exhaust pipe 30 may be integrally and protrusively formed in the inner wall of the cylindrical portion 23*d*, and the end portion 31 on the front side of the exhaust pipe 30 may be positioned using the positioning rib 23*f* of the inner wall of this cylindrical portion 23*d* and be fixed by welding (the welded portion is designated by reference sign E). Thus, the end portion 31 on the front side of the exhaust pipe 30 will not go too deep in the inner wall of the cylindrical portion 23*d*, and the end portion 31 on the front side of the exhaust pipe 30 can be easily and reliably positioned on the cylindrical portion 23*d* and be fixed thereto by welding.

Moreover, according to the first embodiment, the outer cylinder is constituted from the thin plate member, which is divided into two along the axis direction of the turbine shaft of the turbine wheel, but may be constituted from a thin plate member which is divided into two along a direction perpendicular to the axis direction of the turbine shaft of the turbine wheel.

Furthermore, according to the first embodiment, the one completely covering the inner cylinder with the outer cylinder has been explained, but the one not covering the inner cylinder with the outer cylinder may be used, not to mention.

Moreover, according to the first embodiment, a scroll member made of a casting formed by casting as a material having a higher heat-resistance than that of one made from a sheet metal is used, but a scroll member formed from a material other than the casting may be used.

[Second Embodiment]

Figure 8:
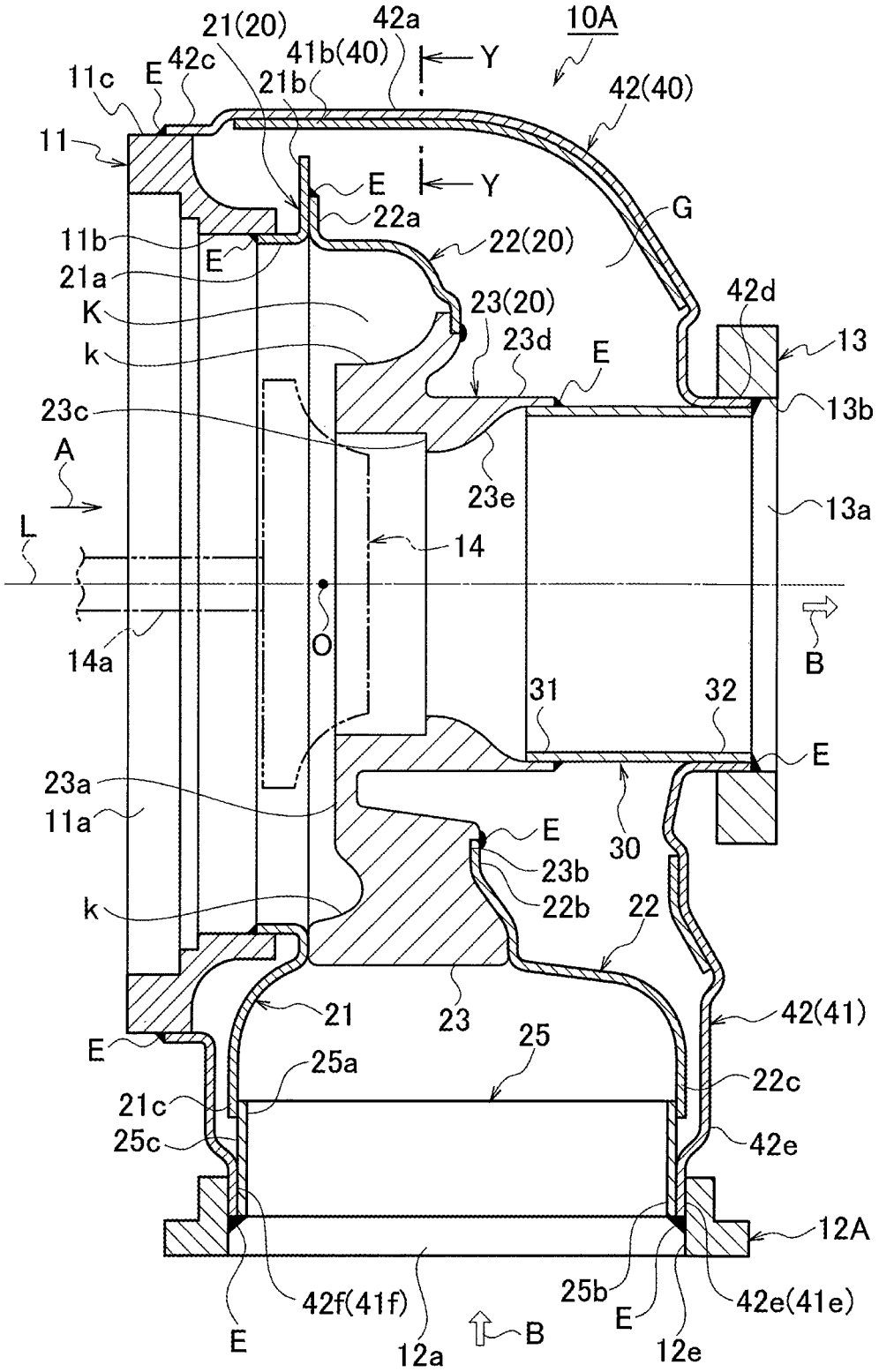
FIG. 8 is a cross sectional view of a turbine housing used for a turbocharger of a second embodiment of the present invention.

FIG. 8 is a cross sectional view of a turbine housing used for a turbocharger of a second embodiment of the present invention in the case where a countermeasure against exhaust gas leakage is required.

In a turbine housing 10A of this second embodiment, an exhaust inlet side flange 12A is formed from a press-molded sheet metal, which differs from the exhaust inlet side flange 12 made of a casting of the first embodiment. Moreover, the lower end portions 41*e* and 42*e* of the first and second outer cylinder split bodies 41 and 42 made of a sheet metal on the exhaust inlet side of the outer cylinder 40 are fixed, by welding (the welded portion is designated by reference sign E), to an inner circumferential surface 12*e* of the opening portion 12*a* of the exhaust inlet side flange 12A made of a sheet metal, and a lower end portion 25*b* of a color 25 (reinforcing board) made of a sheet metal is fixed to the lower end portions 41*e* and 42*e* of the first and second outer cylinder split bodies 41 and 42 by welding (the welded portion is designated by reference sign E). Then, the lower end portions 21*c* and 22*c* of the first inner cylinder split body 21 made of a sheet metal and the second inner cylinder split body 22 made of a sheet metal on the exhaust inlet side of the inner cylinder 20 are slidably fitted into an outer circumferential surface 25*c* of the color 25. Note that, since the other arrangement is the same as that of the first embodiment, the same reference sign is given to omit the detailed explanation thereof.

In the turbine housing 10A of this second embodiment, since the exhaust inlet side flange 12A and color 25 are formed from a press-molded sheet metal, the structure can be simplified as compared with the exhaust inlet side flange 12 made of a casting of the first embodiment and a reduction in cost and a reduction in weight can be achieved accordingly.

Moreover, since the lower end portions 21*c* and 22*c* of the first inner cylinder split body 21 made of a sheet metal and the second inner cylinder split body 22 made of a sheet metal on the exhaust inlet side are slidably fitted into the outer circumferential surface 25*c* of the color 25, displacement, due to the thermal expansion, of the first inner cylinder split body 21 and the second inner cylinder split body 22 each including a laminated scroll member made of a sheet metal can be allowed and thus the thermal expansion of the inner cylinder 20 as a scroll portion can be effectively absorbed.

[Third Embodiment]

Figure 9:
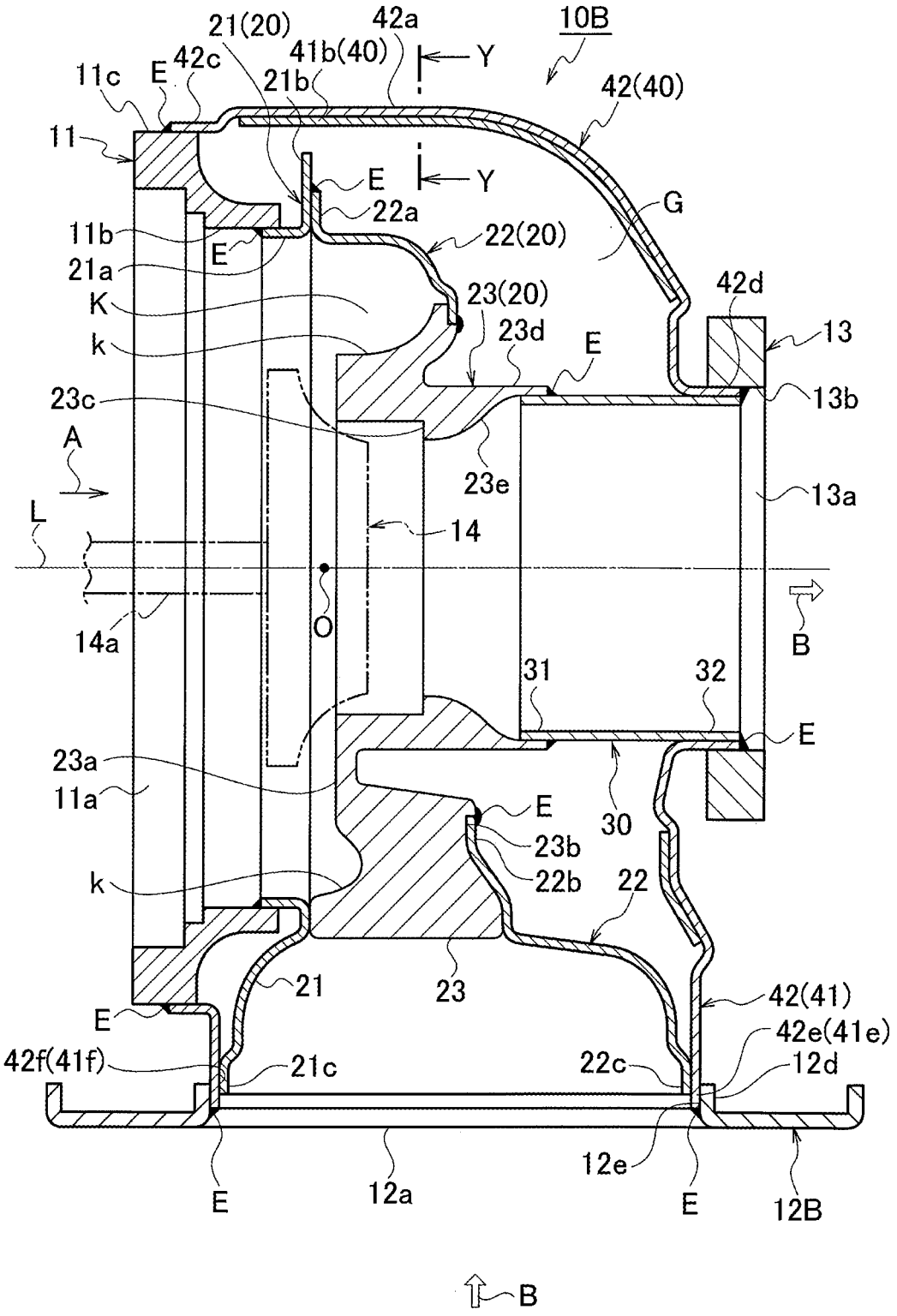
FIG. 9 is a cross sectional view of a turbine housing used for a turbocharger of a third embodiment of the present invention.
Figure 10:
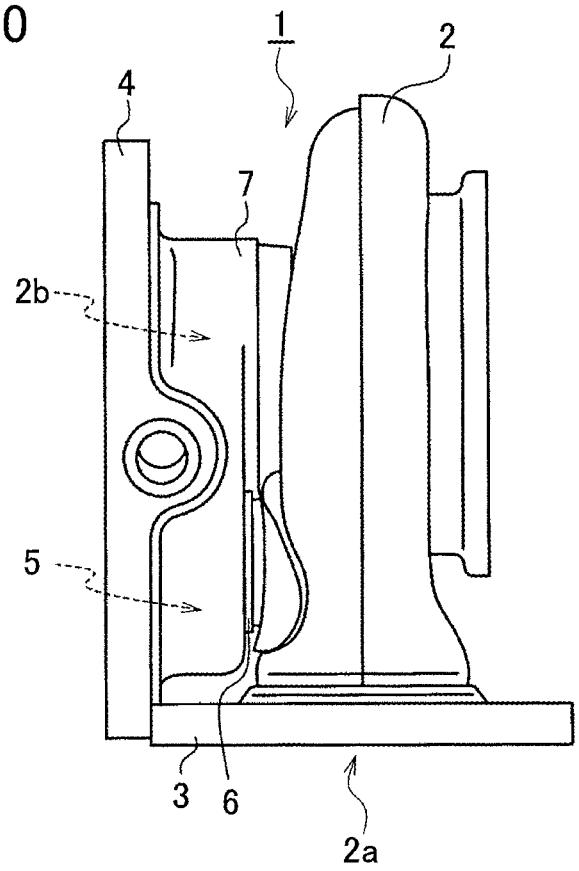
FIG. 10 is a side view illustrating a turbine housing made of a sheet metal used for a conventional turbocharger.
Figure 11:
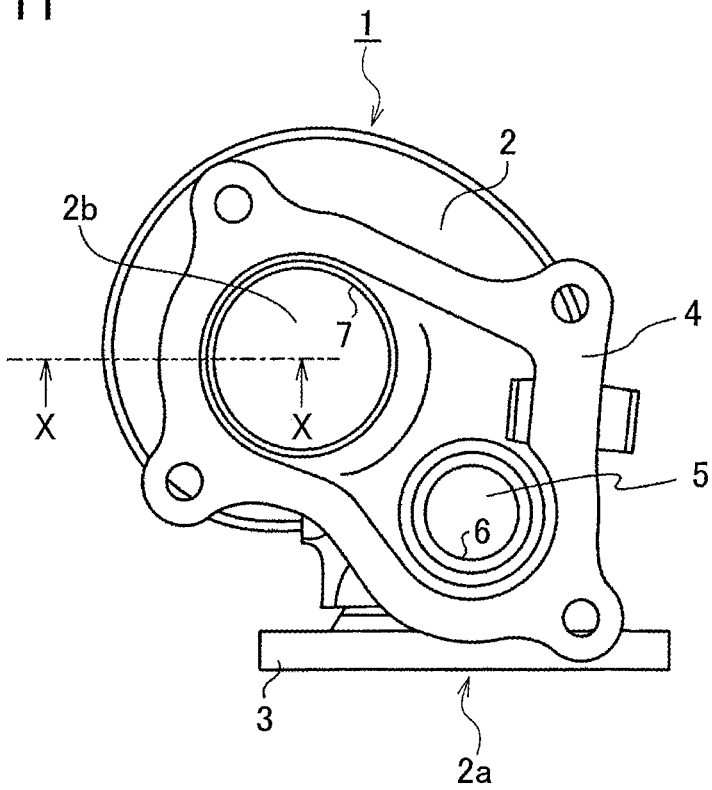
FIG. 11 is a rear view of the turbine housing made of a sheet metal in FIG. 10.
Figure 12:
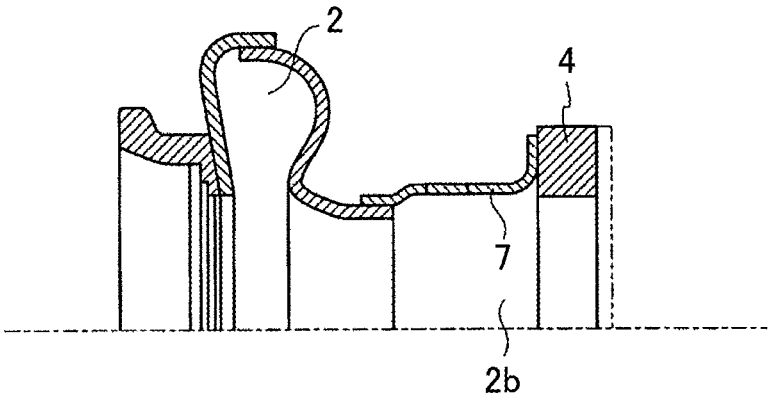
FIG. 12 is a cross sectional view along X-X line in FIG. 11.

FIG. 9 is a cross sectional view of a turbine housing used for a turbocharger of a third embodiment of the present invention in the case where a countermeasure against exhaust gas leakage is not required.

In a turbine housing 10B of this third embodiment, an exhaust inlet side flange 12B is formed from a press-molded thin sheet metal, which differs from the exhaust inlet side flange 12 made of a casting of the first embodiment. Moreover, the lower end portions 41*e* and 42*e* of the first outer cylinder split body 41 made of a sheet metal and the second outer cylinder split body 42 made of a sheet metal on the exhaust inlet side of the outer cylinder 40 are fixed, by welding (the welded portion is designated by reference sign E), to the inner circumferential surface 12*e* of a folded portion 12*d* inside the exhaust inlet side flange 12B made of a sheet metal, and further the lower end portions 21*c* and 22*c* of the first inner cylinder split body 21 made of a sheet metal and the second inner cylinder split body 22 made of a sheet metal on the exhaust inlet side of the inner cylinder 20 are slidably fitted into inner circumferential surfaces 41*f* and 42*f* of the lower end portions 41*e* and 42*e* of the first outer cylinder split body 41 and the second outer cylinder split body 42. Note that, since the other arrangement is the same as that of the first embodiment, the same reference sign is given to omit the detailed explanation thereof.

In the turbine housing 10B of this third embodiment, since the exhaust inlet side flange 12B is formed from a press-molded thin sheet metal, the structure can be further simplified, and a reduction in cost and an improvement in assembling can be further achieved accordingly, as compared with the exhaust inlet side flange 12 made of a casting of the first embodiment and as compared with the case where the color 25 as the reinforcing member of the second embodiment is required.

Moreover, because the lower end portions 21*c* and 22*c* of the first inner cylinder split body 21 made of a sheet metal and the second inner cylinder split body 22 made of a sheet metal on the exhaust inlet side are slidably fitted into the inner circumferential surfaces 41*f* and 42*f* of the lower end portions 41*e* and 42*e* of the first outer cylinder split body 41 and the second outer cylinder split body 42, the displacement, due to the thermal expansion, of the first inner cylinder split body 21 and the second inner cylinder split body 22 each including a laminated scroll member made of a sheet metal can be allowed and thus the thermal expansion of the inner cylinder 20 as the scroll portion can be effectively absorbed.

The present application claims the priority of Japanese Patent Application No. 2015-218366 filed on Nov. 6, 2015, the priority of Japanese Patent Application No. 2015-218367 filed on Nov. 6, 2015, and the priority of Japanese Patent Application No. 2015-218368 filed on Nov. 6, 2015, the entire content of each being incorporated herein by reference.

INDUSTRIAL APPLICABILITY

According to the present invention, in the scroll portion including a spiral exhaust gas passage, an area on the exhaust outlet side of exhaust gas is formed from a scroll member including a material having a higher heat-resistance than that of one made of a sheet metal and the remaining areas of the scroll portion are formed from a scroll member made of a sheet metal. Therefore, the occurrences of thermal deformation, crack, and/or the like of the area on the exhaust outlet side of the scroll portion can be reliably prevented and also stiffness and durability can be improved.

REFERENCE SIGNS LIST

10, 10A, 10B turbine housing
12, 12A, 12B exhaust inlet side flange
12*a* opening portion (inlet for exhaust gas)
12*e* inner circumferential surface
13 exhaust outlet side flange
13*a* opening portion (outlet for exhaust gas)
14 turbine wheel
20 inner cylinder (scroll portion)
21 first inner cylinder split body (scroll board)
21*c* lower end portion
22 second inner cylinder split body (scroll board)
22*b* end portion
22*c* lower end portion
23 third inner cylinder split body (scroll member)
23*b* end portion
23*d* cylindrical portion (tubular portion)
23*e* inclined surface
23*f* rib (projection for positioning)
25 color (reinforcing member)
25*b* lower end portion
25*c* outer circumferential surface
30 exhaust pipe
32 end portion
40 outer cylinder
41 first outer cylinder split body
41*e* lower end portion
41*f* inner circumferential surface
42 second outer cylinder split body
42*e* lower end portion
42*f* inner circumferential surface
B exhaust gas
K exhaust gas passage
k passage face
G gap (predetermined interval)
O revolving central portion (central portion)
E welded portion

The invention claimed is:

1. A turbine housing comprising a scroll portion constituting a spiral exhaust gas passage between an exhaust inlet side flange constituting an inlet for exhaust gas and an exhaust outlet side flange constituting an outlet for the exhaust gas, the turbine housing discharging the exhaust gas to an exhaust outlet side through a turbine wheel disposed in a central portion of the scroll portion, wherein the spiral exhaust gas passage of the scroll portion is formed from at least:

a first scroll member including a material having a higher heat-resistant than that of one made of a sheet metal, and second scroll member made of the sheet metal, wherein the first scroll member is arranged at a part of the scroll portion, from the spiral exhaust gas passage to a region facing the turbine wheel at the exhaust outlet side.

2. The turbine housing according to claim 1, wherein the second scroll member forms a part of the spiral exhaust gas passage between an intake-air inlet side flange constituting an inlet for an intake air and the first scroll member.

3. The turbine housing according to claim 1, wherein the exhaust outlet side flange and the first scroll member are linked through an exhaust pipe made of the sheet metal.

4. A turbine housing comprising a scroll portion constituting a spiral exhaust gas passage between an exhaust inlet side flange constituting an inlet for exhaust gas and an exhaust outlet side flange constituting an outlet for the exhaust gas, the turbine housing discharging the exhaust gas to an exhaust outlet side through a turbine wheel disposed in a central portion of the scroll portion, wherein the spiral exhaust gas passage of the scroll portion is formed from at least:

a first scroll member including a material having a higher heat-resistant than that of one made of a sheet metal, and a second scroll member made of the sheet metal, wherein a cross section of the first scroll member along a flat surface including a rotation center axis of the turbine wheel is formed with:

an inner-side region extending in an extending direction of the rotation center axis on the rotation center axis side and facing the turbine wheel; and an outer-side region folded back from an end portion on a side of the turbine wheel in the extending direction of the rotation center axis on an outside of the inner-side region, the outer-side region projecting to a side separating from the turbine wheel.

5. The turbine housing according to claim 1, wherein a region, in the first scroll member, located on a side of the exhaust inlet side flange is formed thicker than a region located on an opposite side of the exhaust inlet side flange.

6. The turbine housing according to claim 1, wherein the scroll portion is constituted from an inner cylinder including:

a first inner cylinder split body and a second inner cylinder split body each including the second scroll member; and a third inner cylinder split body including the first scroll member and being located at a region facing the turbine wheel, and wherein the inner cylinder is covered with an outer cylinder including an outer cylinder split body made of the sheet metal, with a predetermined spacing between the inner cylinder and the outer cylinder.

7. The turbine housing according to claim 6, wherein the inner cylinder is abutted against the exhaust inlet side flange and the outer cylinder is fixed to the exhaust inlet side flange by welding.

8. The turbine housing according to claim 6, wherein an end portion of the second inner cylinder split body and an end portion of the third inner cylinder split body are joined by welding from an opposite side face of a passage face of the exhaust gas passage.

9. The turbine housing according to claim 3, wherein an inner wall of a tubular portion on the exhaust outlet side of the first scroll member is formed in an inclined surface expanding toward the exhaust outlet side, and wherein an end portion of the exhaust pipe is fitted into the inclined surface and is fixed by welding.

10. The turbine housing according to claim 3, wherein a projection for positioning is formed in an inner wall of a tubular portion on the exhaust outlet side of the first scroll member, and wherein an end portion of the exhaust pipe is positioned by the projection and is fixed by welding.

11. The turbine housing according to claim 6, wherein a lower end portion of the outer cylinder split body is fixed, by welding, to an inner circumferential surface of an opening portion of the exhaust inlet side flange made of the sheet metal, wherein a lower end portion of a reinforcing board is fixed to the lower end portion of the outer cylinder split body by welding, and wherein a lower end portion of the first inner cylinder split body and a lower end portion of the second inner cylinder split body are slidably fitted into an outer circumferential surface of the reinforcing board.

12. The turbine housing according to claim 6, wherein a lower end portion of the outer cylinder split body is fixed, by welding, to an inner circumferential surface of an opening portion of the exhaust inlet side flange made of the sheet metal, and wherein a lower end portion of the first inner cylinder split body and a lower end portion of the second inner cylinder split body are slidably fitted into an inner circumferential surface of the lower end portion of the outer cylinder split body.

13. The turbine housing according to claim 1, wherein the material having the higher heat-resistance than that of one made from the sheet metal is formed by casting.

14. The turbine housing according to claim 1, wherein the first scroll member and the second scroll member are joined by welding and constitute a spiral shape.

15. The turbine housing according to claim 14, wherein a welded portion between the first scroll member and the second scroll member is located on an opposite side face of a passage face of the exhaust gas passage.

* * * * *